US009057206B2

(12) United States Patent
Lin

(10) Patent No.: US 9,057,206 B2
(45) Date of Patent: Jun. 16, 2015

(54) PORTABLE COMBINATION UMBRELLA AND TENT

(71) Applicant: Matthew Stephen Lin, Cedar Park, TX (US)

(72) Inventor: Matthew Stephen Lin, Cedar Park, TX (US)

( * ) Notice: Subject to any disclaimer, the term of this patent is extended or adjusted under 35 U.S.C. 154(b) by 13 days.

(21) Appl. No.: 13/842,865

(22) Filed: Mar. 15, 2013

(65) Prior Publication Data

US 2014/0261597 A1 Sep. 18, 2014

(51) Int. Cl.
*E04H 15/28* (2006.01)
*A45B 11/00* (2006.01)
*A45B 23/00* (2006.01)

(52) U.S. Cl.
CPC ..... *E04H 15/28* (2013.01); *Y10T 29/49826* (2015.01); *A45B 11/00* (2013.01); *A45B 23/00* (2013.01); *A45B 2023/0006* (2013.01)

(58) Field of Classification Search
CPC ..... A45B 23/00; A45B 2023/0006; A45B 2023/0012; E04H 15/28; E04H 15/30
USPC ..... 135/16, 98
See application file for complete search history.

(56) References Cited

U.S. PATENT DOCUMENTS

| | | | | |
|---|---|---|---|---|
| 44,482 | A | | 9/1864 | Clarke |
| 74,933 | A | | 2/1868 | Palmer |
| 321,722 | A | | 7/1885 | Herron |
| 373,378 | A | | 11/1887 | Rumrille |
| 574,091 | A | | 12/1896 | Irvine |
| 941,458 | A | | 11/1909 | Leach |
| 1,774,909 | A | * | 9/1930 | Wells ..... 135/98 |
| 1,854,671 | A | * | 4/1932 | Roberts ..... 24/537 |
| 2,221,366 | A | | 11/1940 | Bisbing et al. |
| 2,652,845 | A | | 9/1953 | O'Neill et al. |
| 3,151,621 | A | | 10/1964 | Jackson |
| 3,333,595 | A | | 8/1967 | Bannister et al. |
| 3,419,024 | A | | 12/1968 | Nickerson, Jr. |
| 3,477,453 | A | | 11/1969 | D'Ulisse et al. |
| 3,889,698 | A | | 6/1975 | Roessl |
| 3,892,251 | A | | 7/1975 | Warfield |
| 3,899,168 | A | | 8/1975 | Besherse |
| 4,022,233 | A | | 5/1977 | Grundman |
| 4,086,931 | A | | 5/1978 | Hall |
| 4,449,542 | A | | 5/1984 | McSwain et al. |
| 4,506,688 | A | * | 3/1985 | Bethoon et al. ..... 135/140 |
| 5,172,712 | A | | 12/1992 | Robinson |
| D336,504 | S | | 6/1993 | Castro |
| 5,287,872 | A | | 2/1994 | Anderson |
| 5,664,595 | A | * | 9/1997 | Vonderhorst et al. ..... 135/16 |
| 5,678,587 | A | | 10/1997 | Bilotti |
| 5,806,547 | A | * | 9/1998 | Derlinga ..... 135/33.2 |

(Continued)

FOREIGN PATENT DOCUMENTS

GB 2262551 A * 6/1993 ..... E04H 15/28

*Primary Examiner* — Noah Chandler Hawk

(57) ABSTRACT

Portable combination umbrella and tent and method of providing and making the same are disclosed. The umbrella has a frame, a handle, a first tier covering, and a second tier covering. The first tier covering and the second tier covering are coupled to the frame so that an overlapping area exists between the first tier covering and the second tier covering. A tent support is movably coupled to the frame. The tent support can be moved and adjusted in a number of tent positions and also stowed away as part of the umbrella. A tent covering is coupled to the umbrella. The tent support can support the tent covering in the tent positions. At least part of the tent covering can be folded up and stored in the overlapping area so that the portable umbrella and tent can be used as an umbrella.

20 Claims, 9 Drawing Sheets

(56) References Cited

U.S. PATENT DOCUMENTS

| | | | | |
|---|---|---|---|---|
| 5,918,611 | A | 7/1999 | Amato | |
| 5,921,259 | A | 7/1999 | Ehler | |
| 6,085,768 | A * | 7/2000 | Arlotta | 135/98 |
| 6,698,440 | B2 | 3/2004 | Beyer et al. | |
| 7,096,875 | B2 | 8/2006 | Dubinsky-Witkowski | |
| 7,434,591 | B2 | 10/2008 | Church | |
| 7,793,674 | B2 * | 9/2010 | Elder | 135/33.2 |
| D627,553 | S | 11/2010 | Elder | |
| 7,918,236 | B2 | 4/2011 | Elder | |
| 8,042,561 | B2 | 10/2011 | Moravec Varga et al. | |
| D655,774 | S | 3/2012 | Novak | |
| 8,181,811 | B1 * | 5/2012 | Blake | 220/475 |
| 2002/0036007 | A1 | 3/2002 | Sellers | |
| 2002/0046480 | A1 | 4/2002 | Kowalski | |
| 2002/0108645 | A1 | 8/2002 | Beyer et al. | |
| 2005/0011134 | A1 * | 1/2005 | Boltan et al. | 52/3 |
| 2005/0028851 | A1 | 2/2005 | Knoepp | |
| 2006/0005871 | A1 | 1/2006 | Church | |
| 2006/0180189 | A1 | 8/2006 | Bambei et al. | |
| 2012/0006370 | A1 | 1/2012 | Liljekvist et al. | |

* cited by examiner

PORTABLE COMBINATION UMBRELLA AND TENT

FIELD OF INVENTION

The present invention generally relates to an umbrella and a tent, and, more particularly, to a portable apparatus or device that can be used both as an umbrella and a tent.

BACKGROUND OF THE INVENTION

Umbrellas and tents are well known in the art, and various umbrellas and tents exist in general. Umbrellas that have a two tier covering in which one tier at least slightly overlaps the other tier also exist. Devices that serve both purposes as an umbrella and a tent do exist. However, the challenge with these dual functioning devices is to make them conveniently portable, easy to use, and easy to switch between different use position(s) and storage position(s). The need and desire to continue to make them more convenient to set up, use, collapse, switch between positions, and/or to be very portable and to improve their overall functionality and operation still exist.

The uses for such a portable and convenient dual functioning device are numerous. Such uses include but are not limited to serving as temporary umbrellas and shelters for the homeless, for folks in disaster recovery areas, for people in third world countries that do not have the resources to build permanent homes/structures, and can also be used for recreational purposes and applications as well (e.g., for the beach, camping, etc.). For example, in the case of a homeless person, he/she would use an umbrella, rain gear, cardboard or cardboard box structure or have to go under bridges/overpasses to seek temporary relief/shelter when the weather gets bad (e.g., starts raining). A homeless person also has belongings to carry, no he/she may have a backpack or a cart (e.g., shopping cart) to be able carry his/her things around. In addition, folks who are homeless may separately carry an umbrella to anticipate weather conditions and a tent for a place to sleep. Thus, a homeless person is generally set up and operates in ways to be very mobile. Such a device would also be desired and/or needed to be made inexpensively because of its type of portable uses and applications and because the market for such a device would generally warrant a relatively inexpensive product.

Therefore, the need and desire for a very easy to use and store, versatile, inexpensive, highly mobile, portable combination umbrella and tent exist.

SUMMARY OF THE INVENTION

A portable combination umbrella and tent and method of providing and making a portable umbrella and tent are disclosed. The umbrella has a frame, a handle coupled to the frame, a first tier covering coupled to the frame, and a second tier covering coupled to the frame. The first tier covering and the second tier covering are coupled to the frame so that an overlapping area exists between the first tier covering and the second tier covering. A tent support is movably coupled to the frame. The tent support can be moved and adjusted in a tent position and also stowed away as part of the umbrella. A tent covering is coupled to the umbrella. The tent support can support the tent covering in the tent position. At least part of the tent covering can be folded up and stored in the overlapping area so that the portable umbrella and tent can be used as an umbrella.

At least part of the tent covering is removably fixed to the first tier covering and/or the second tier covering. The tent support can be telescoping legs movably coupled to the frame. The telescoping legs can be adjusted to support the tent covering in the tent position and can be stowed away so that the portable umbrella and tent can be used as an umbrella. The tent support rods are coupled to respective rods of the frame. The telescoping legs are slidingly mounted to the tent support rods so that the telescoping legs can be movably adjusted to the tent position and can also be movably adjusted to be stowed away.

The tent position can be a plurality of positions. The telescoping legs can be movably adjusted to the plurality of positions. The plurality of positions includes but is not limited to a standing tent position, a sitting/lying down tent position, and a recreational tent position. A base structure, such as a rolling luggage, can be coupled to the handle of the umbrella to provide further support when the portable umbrella and tent is in the standing position.

DETAILED DESCRIPTION

Figure 1:
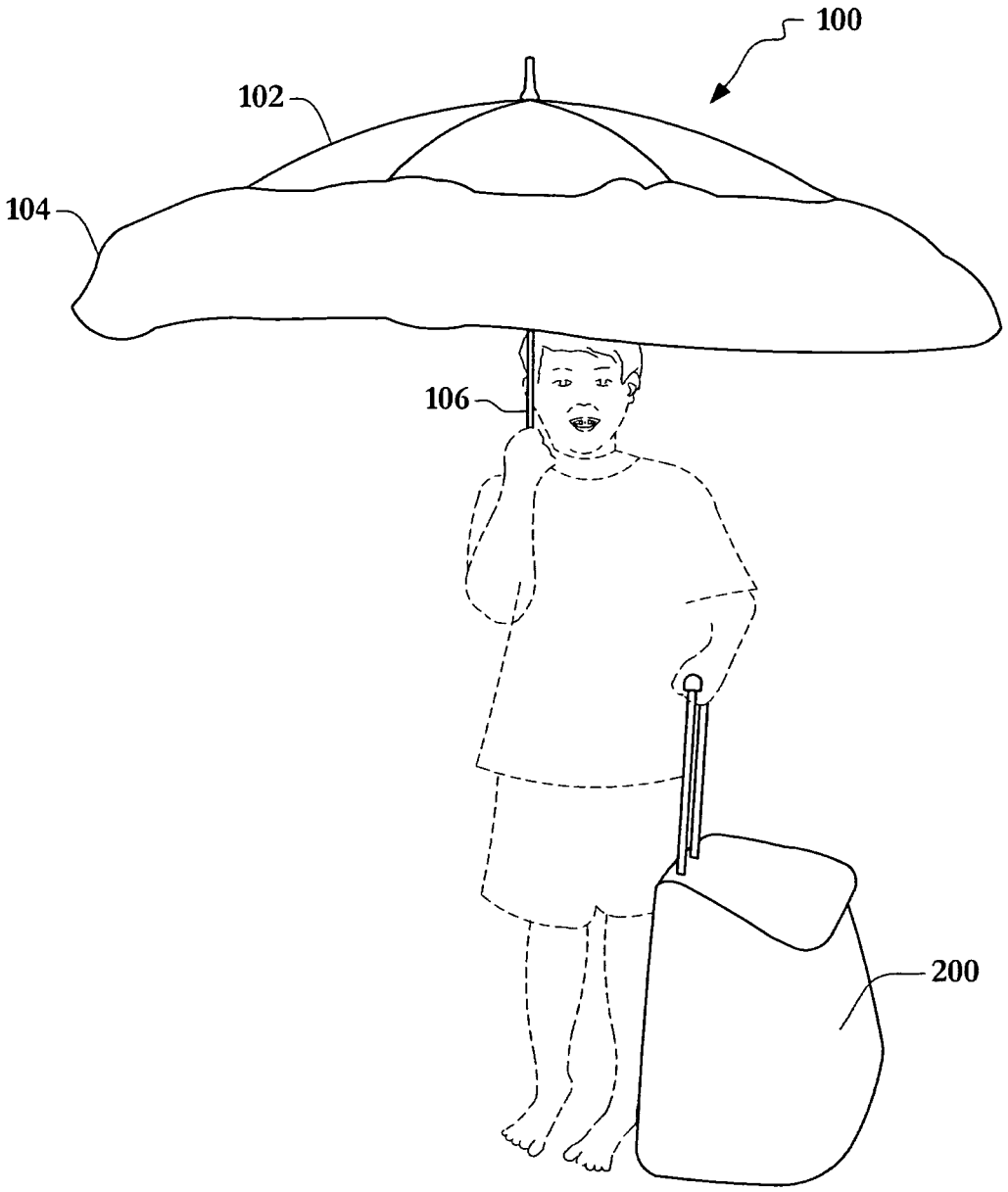
FIG. 1 is a view of an exemplary portable combination umbrella and tent shown being used as an umbrella in accordance with the present disclosure.

FIG. 1 shows an exemplary portable combination umbrella and tent 100 in accordance with the present disclosure. Portable umbrella and tent 100 is shown being used as an umbrella in FIG. 1. Portable umbrella and tent 100 shows an umbrella 102 and a tent covering(s) 104 attached or coupled to the umbrella. The tent covering 104 can be made from any suitable material, such as tent material, rain gear material (such as rain ponchos), or any other suitable rain proof material. Tent covering(s) 104 can be attached to umbrella 102 in any number of suitable ways. One exemplary way of attaching is to staple or sew an edge(s) of the tent covering(s) 104 to a respective edge of the umbrella 102 when umbrella 102 is in the open position.

Figure 2:
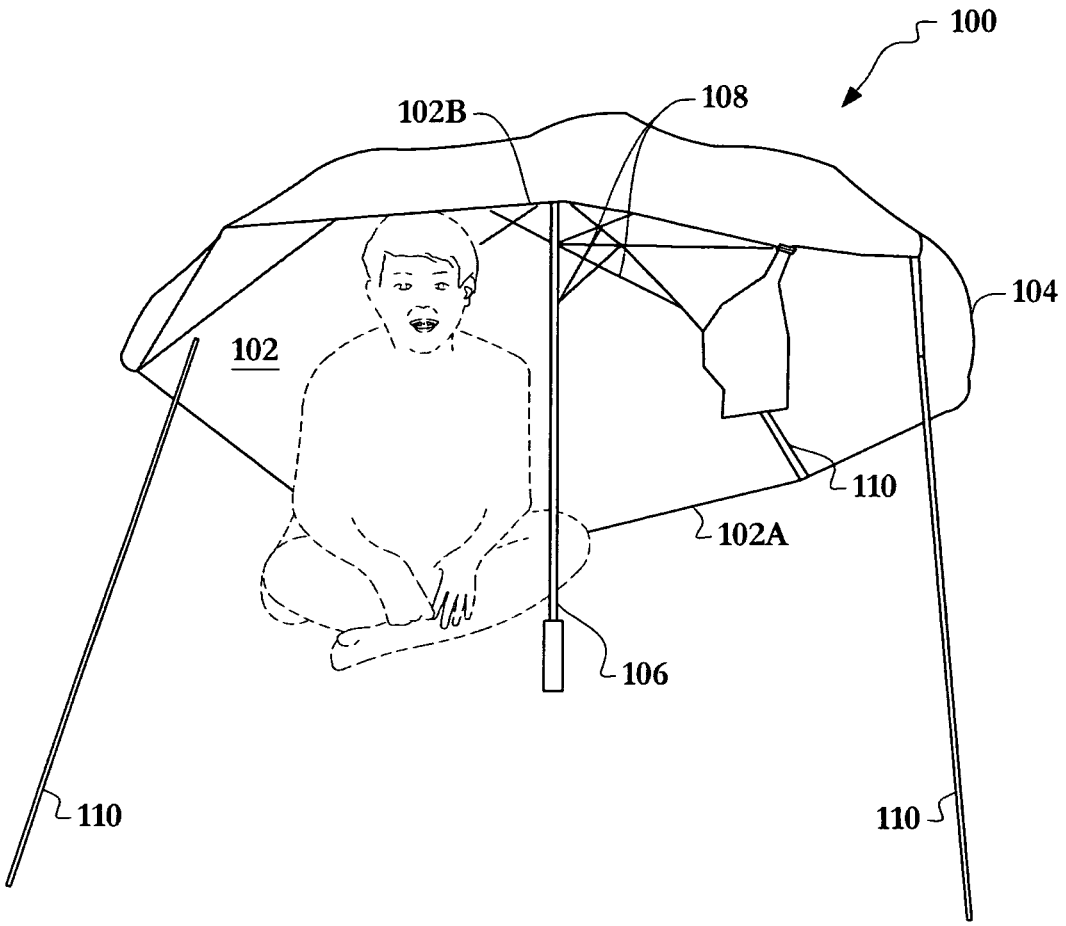
FIG. 2 is a view of an exemplary portable combination umbrella and tent shown being used as a tent in an exemplary open sitting position in accordance with the present disclosure.
Figure 3:
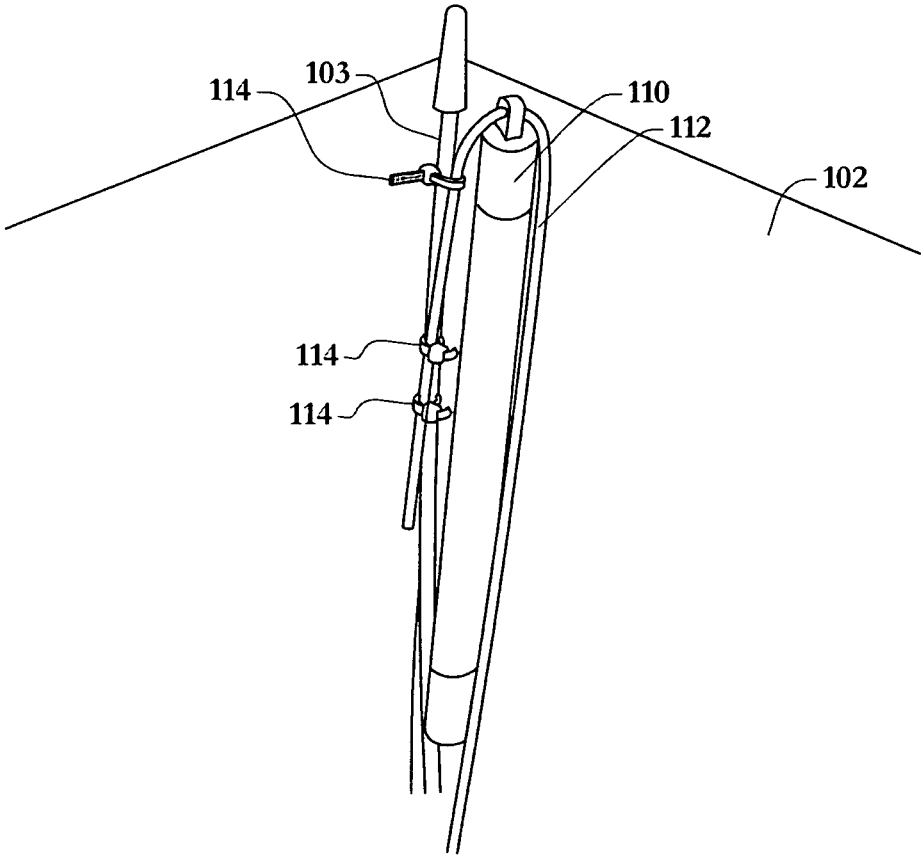
FIG. 3 is a view of an exemplary tent support rod and an exemplary telescoping leg mounted to the inside frame of an umbrella in accordance with the present disclosure.

FIGS. 2 and 3 show more details of portable umbrella and tent 100. Umbrella 102 has a frame 108 and a handle 106 attached to its frame 108. In FIG. 3, portable umbrella and tent 100 also has tent support rods 112 mounted or coupled to respective frame rods 103 that are part of frame 108 of umbrella 102. FIG. 3 shows that tent support rods 112 are attached to the respective frame rods 103 by using cable ties 114. Tent supports 110 are movably mounted to the tent support rods 112, and thus, tent supports 110 are effectively movably coupled to the frame 108. Tent supports 110 can be telescoping legs, such as telescoping legs that are used on tripods.

Tent supports 110 (or telescoping legs) can be moved and adjusted in different positions so that they can support the tent covering(s) in one or more different tent positions. In FIG. 3, tent support 110 (e.g., telescoping leg) is slidingly mounted to the tent support rod 112 so that the telescoping leg can be movably/rotatably hand from tent support rod 112 and be movably adjusted to one of the desired tent positions or can be movably/rotatably adjusted to be stowed away as shown in FIG. 3. Tent support 110 (e.g., telescoping leg) is mounted to tent support rod 112 in a way that allows tent support 110 to slide and rotate/swing along tent support rod 112. For example, the tent support(s) 100 is/are stowed away when portable umbrella and tent 100 is not being used as a tent and/or when portable umbrella and tent 100 is being used as an umbrella.

Figure 4A:
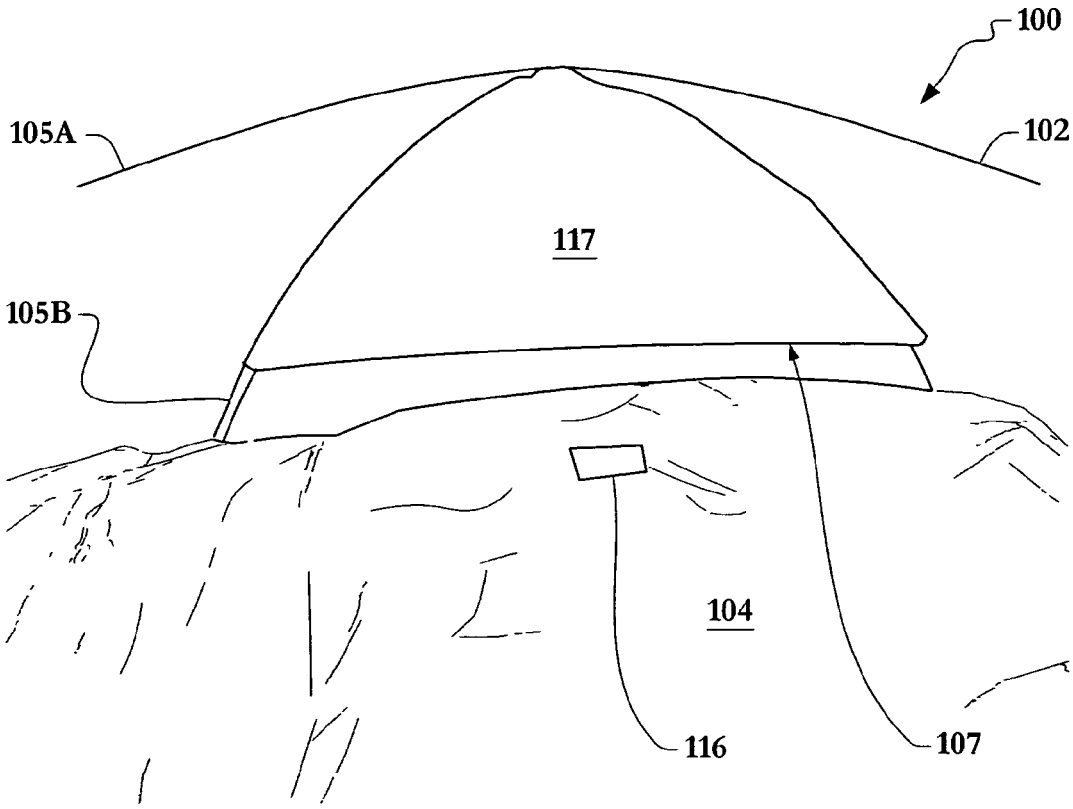
FIG. 4A is a view of an exemplary tent covering attached to an umbrella and shown being able to be folded up.
Figure 4B:
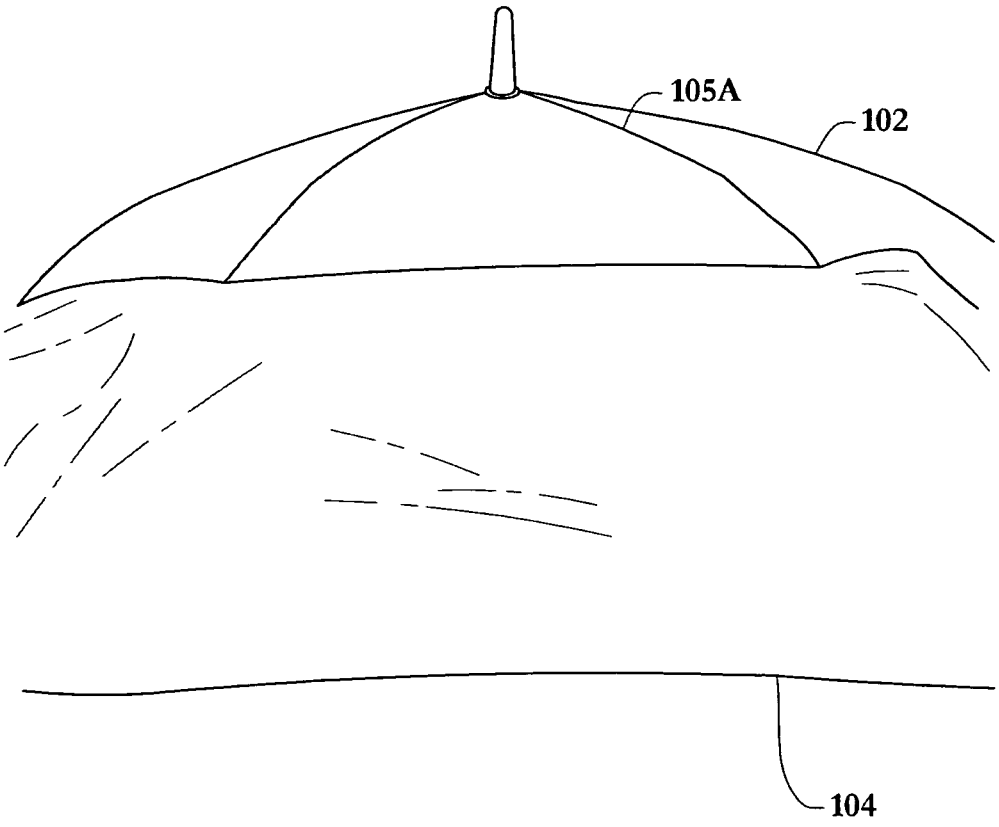
FIG. 4B is a view of the exemplary tent covering of FIG. 4A folded up and stored between the first and second tier coverings of an umbrella.

FIGS. 4A and 4B show exemplary details of how the tent covering 104 is folded up, stored and secured to umbrella 102. Umbrella 102 further has a first tier covering 105A and a second tier covering 105B. First tier covering 105A and second tier covering 105B are coupled to frame 108 so that an overlapping area 107 exists between first tier covering 105A and second tier covering 1058 (see FIG. 4A). FIG. 4B shows that at least part of tent covering 104 can be folded up and stored in the overlapping area 107. The tent covering 104 when folded up and stored can further be removably fixed to the first tier covering 105A and/or the second tier covering 105B. Any suitable material, device, or method can be used for removably fixing the tent covering 104 to the first tier covering 105A and/or the second tier covering 105B. In FIG. 4A, exemplary Velcro® hook and loop fasteners 116 and 117 are used to removably fix tent covering 104 to the first tier covering 105A. Referring back to FIG. 1, all of the tent covering(s) 104 is/are folded up (out of the way), stored, and secured to first tier covering 105A and/or second tier covering 105B so that portable umbrella and tent 100 can be used as an umbrella.

With respect to portable umbrella and tent 100 being used as a tent, FIGS. 2, 5, 6, 7, and 8 illustrate exemplary tent positions. FIG. 2 shows portable umbrella and tent 100 in an exemplary open sitting tent position in accordance with the present disclosure. In the open sitting position, two tent supports 110 (e.g., telescoping legs) are extended while a third or other tent support(s) 110 is/are in the stowaway position. Umbrella 102 generally has the side 102A that has the tent support(s) 110 in the stowaway position on the ground while the side 102B that has the extended tent support(s) 110 is above the ground. In the open sitting position, a person is able to sit or even lie down inside the portable umbrella and tent 100 and is able to enjoy the openness of air since the tent covering(s) 104 on at least the side 102B is in the folded up and stored position and is out of the way of the user.

Figure 5:
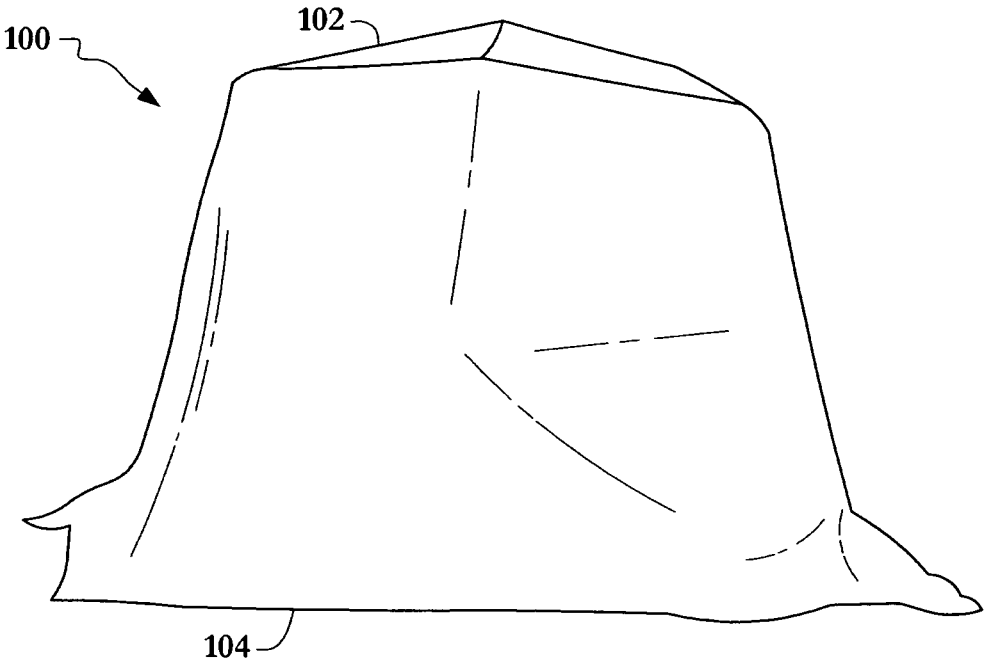
FIG. 5 is a view of an exemplary portable combination umbrella and tent shown being used as a tent in an exemplary closed sitting position in accordance with the present disclosure.

FIG. 5 shows portable umbrella and tent 100 in an exemplary closed sitting tent position in accordance with the present disclosure. The closed sitting tent position is similar to the open sitting tent position as disclosed in FIG. 2 except that the tent covering(s) 104 on at least the side 102B is folded down and covers up the open area. In the closed sitting tent position, a person can sit or even lie down inside the portable umbrella and tent 100 and enjoy privacy in the tent structure.

Figure 6:
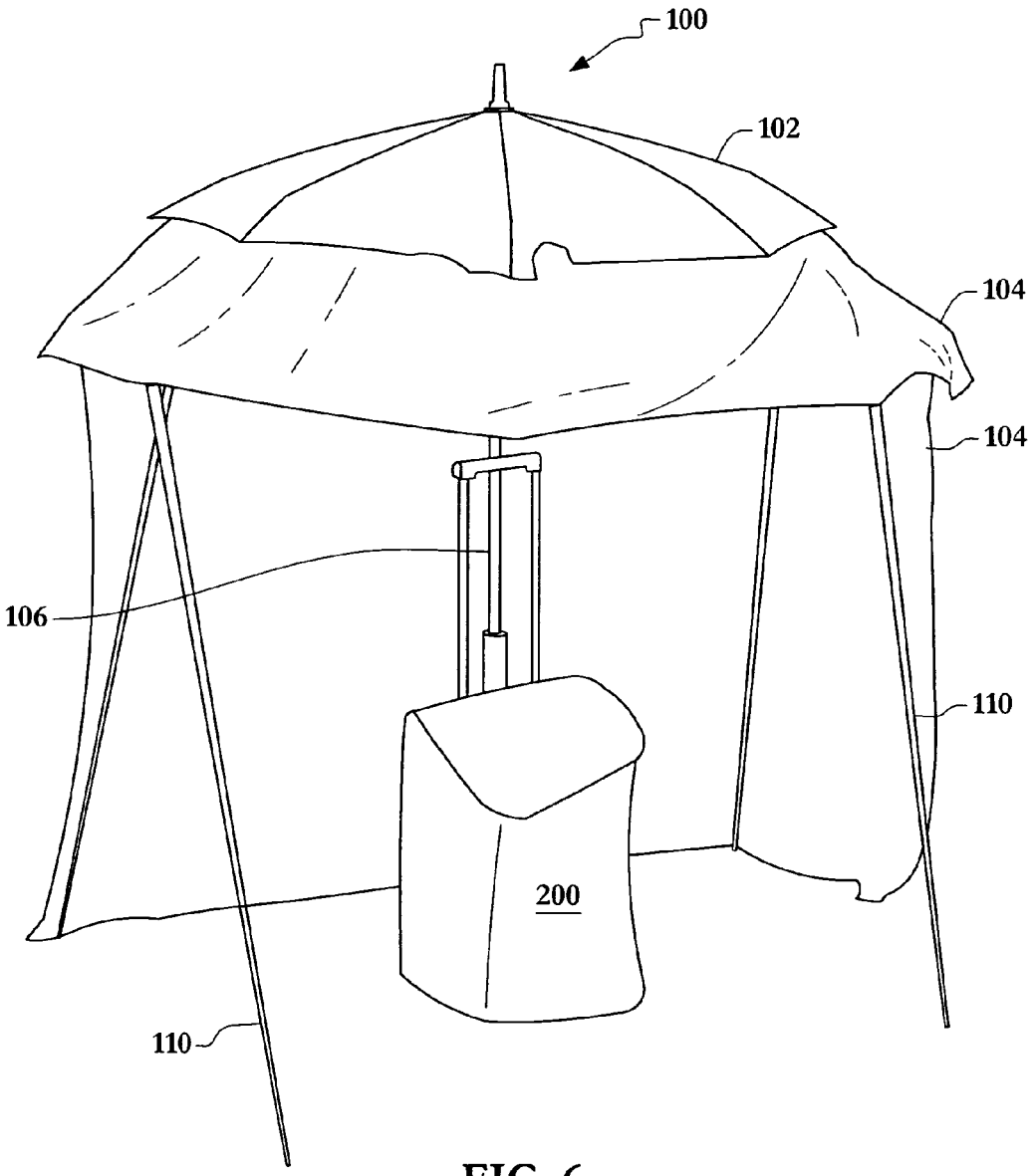
FIG. 6 is a view of an exemplary portable combination umbrella and tent shown being used as a tent in an exemplary open standing position in accordance with the present disclosure.

FIG. 6 shows portable umbrella and tent 100 in an exemplary open standing tent position in accordance with the present disclosure. In the open standing tent position, some to all of the tent supports 110 (e.g., telescoping legs) are extended so that the portable umbrella and tent 100 can be in a standing up position. First tier covering 105A and second tier covering 105B generally sit above the ground. The handle 106 is positioned in a way to be supported by the ground. For example, the handle 106 can be attached to a base structure 200, and base structure 200 can provide further standing and structural support for portable umbrella and tent 100 in the standing tent position. Any suitable material, device, or method can be used to attach or support the handle 106 to base structure 200, such as string, ribbon, wire, etc. For example, the base structure 200 can be a rolling luggage, such as a rolling backpack. At least part or all of the tent covering(s) is in the folded up and stored position. In the open standing position, a person is able to stand inside the portable umbrella and tent 100 and is able to enjoy the openness of air since at least part of or all of the tent covering(s) 104 is in the folded up and stored position.

Figure 7:
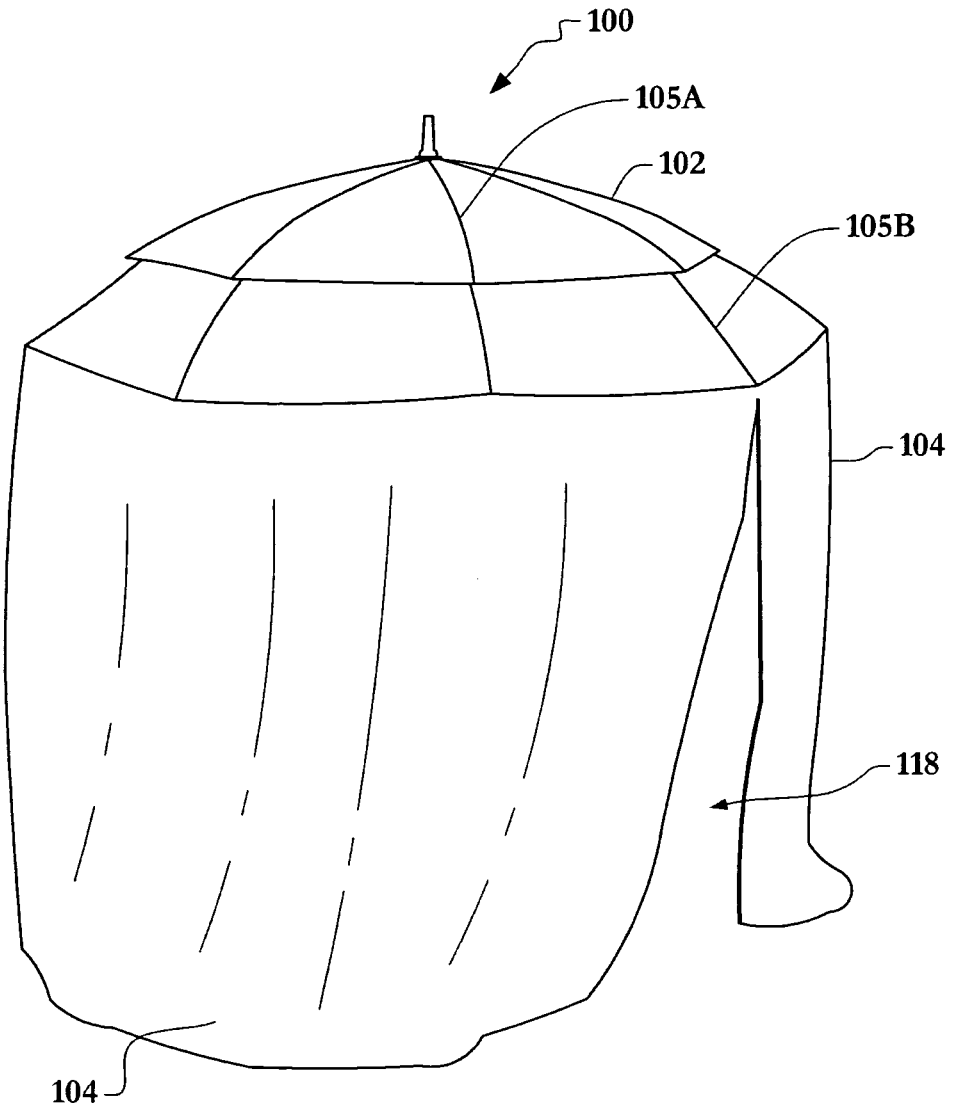
FIG. 7 is a view of an exemplary portable combination umbrella and tent shown being used as a tent in an exemplary open standing position in accordance with the present disclosure.

FIG. 7 shows portable umbrella and tent 100 in an exemplary closed standing tent position in accordance with the present disclosure. The closed standing tent position is similar to the open standing tent position as disclosed in FIG. 5 except that the tent covering(s) 104 is folded down and covers up the open area. In the closed standing position, a person is able stand inside the portable umbrella and tent 100 and enjoy privacy in the tent structure. An access opening 118 exists at the side of the portable umbrella and tent 100 so that a user can enter and leave the tent structure.

Figure 8:
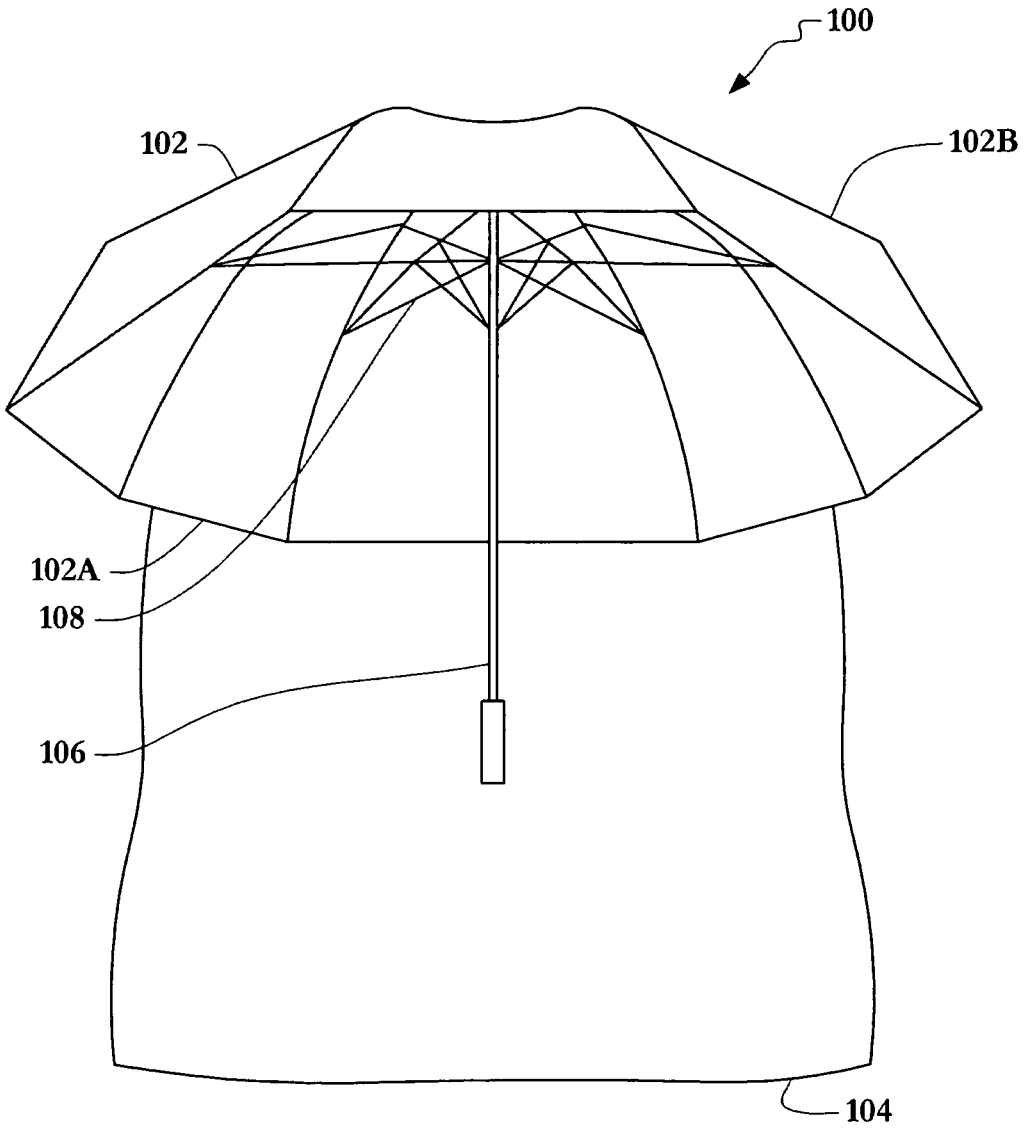
FIG. 8 is a view of an exemplary portable combination umbrella and tent shown being used as a recreational tent in accordance with the present disclosure.

FIG. 8 shows portable umbrella and tent 100 being used as a recreational tent in accordance with the present invention. The tent covering(s) 104 is/are rolled out on one side and placed along the ground while the other part(s) of the tent covering(s) either does not exist (as shown in FIG. 8) or is/are folded up and stored away. The side 102A of umbrella 102 generally sits on the ground while the side 102B of umbrella 102 sits above the ground. The tent covering(s) 104 rolled out along the ground provides a place for a person to comfortably sit, stand, or lie down while at the same enjoy the shade of the umbrella 102.

Portable umbrella and tent 100 can be made inexpensively, portable, and versatile, and it can easily be made with off-the-shelf parts (e.g, an umbrella, tripod legs, staples, Velcro® hook and loop fasteners, rain ponchos, metal rods, and cable ties).

Although embodiments have been described in detail, it should be understood that various changes, substitutions, and alterations can be made hereto without departing from the spirit and scope of the invention as defined by the appended claims.

What is claimed is:

1. A portable umbrella and tent, comprising:

an umbrella having a frame, a handle coupled to the frame, a first tier covering coupled to the frame, and a second tier covering coupled to the frame wherein the first tier covering and the second tier covering are coupled to the frame so that an overlapping area exists between the first tier covering and the second tier covering;

a tent support movably coupled to the frame wherein the tent support can be moved and adjusted in a tent position and also stowed away as part of the umbrella; and a tent covering coupled to the umbrella wherein the tent support can support the tent covering in the tent position; and wherein at least part of the tent covering can be folded up and stored between the first tier covering and the second tier covering in the overlapping area so that the portable umbrella and tent can be used as an umbrella.

2. The portable umbrella and tent according to claim 1, wherein the at least part of the tent covering is removably fixed to the first tier covering.

3. The portable umbrella and tent according to claim 1, wherein the at least part of the tent covering is removably fixed to the second tier covering.

4. The portable umbrella and tent according to claim 1 wherein the tent support further comprises:

telescoping legs movably coupled to the frame wherein the telescoping legs can be adjusted to support the tent covering in the tent position and can be stowed away so that the portable umbrella and tent can be used as an umbrella.

5. The portable umbrella and tent according to claim 4, further comprising tent support rods coupled to respective rods of the frame and wherein the telescoping legs are slidingly mounted to the tent support rods so that the telescoping legs can be movably adjusted to the tent position and can also be movably adjusted to be stowed away.

6. The portable umbrella and tent according to claim 5, wherein the tent position is a plurality of positions and the telescoping legs can be movably adjusted to the plurality of positions.

7. The portable umbrella and tent according to claim 6, wherein one of the plurality of positions is a standing tent position.

8. The portable umbrella and tent according to claim 6 wherein one of the plurality of positions is a member of a group of a sitting tent position and a lying down tent position.

9. The portable umbrella and tent according to claim 6, wherein one of the plurality of positions is a recreational tent position.

10. A method of providing and using a portable umbrella and tent, comprising:

providing an umbrella having a frame, a handle coupled to the frame, a first tier covering coupled to the frame, and a second tier covering coupled to the frame;

coupling the first tier covering and the second tier covering to the frame so that an overlapping area exists between the first tier covering and the second tier covering;

movably coupling a tent support to the frame wherein the tent support can be moved and adjusted in a tent position and also stowed away as part of the umbrella; and coupling a tent covering to the umbrella;

supporting, by the tent support, the tent covering in the tent position; and folding up and storing at least part of the tent covering between the first tier covering and the second tier covering in the overlapping area so that the portable umbrella and tent can be used as an umbrella.

11. The method according to claim 10, further comprising:

removably fixing the at least part of the tent covering to the first tier covering.

12. The method to claim 10, further comprising:

removably fixing the at least part of the tent covering to the second tier covering.

13. The method according to claim 10, wherein the tent support further comprises telescoping legs and wherein the method further comprises:

movably coupling the telescoping legs to the frame wherein the telescoping legs can be adjusted to support the tent covering in the tent position and can be stowed away so that the portable umbrella and tent can be used as an umbrella.

14. The method according to claim 13, further comprising:

coupling tent support rods to respective rods of the frame; and slidingly mounting the telescoping legs to the tent support rods so that the telescoping legs can be movably adjusted to the tent position and can also be movably adjusted to be stowed away.

15. The method according to claim 14, wherein the tent position is a plurality of positions and further comprising:

movably adjusting the telescoping legs to the plurality of positions.

16. The method according to claim 15, wherein one of the plurality of positions is a standing tent position.

17. The method according to claim 16, further comprising:

coupling a base structure to the handle to provide further support when the portable umbrella and tent is in the standing tent position.

18. The method according to claim 17, wherein the base structure is a rolling luggage.

19. The method according to claim 15, wherein one of the plurality of positions is at least one of a sitting tent position and a lying down tent position.

20. The method according to claim 15, wherein one of the plurality of positions is a recreational tent position.

* * * * *